US007607947B1

(12) United States Patent
Ho

(10) Patent No.: US 7,607,947 B1
(45) Date of Patent: Oct. 27, 2009

(54) ELECTRICAL CONNECTOR

(75) Inventor: Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/232,693

(22) Filed: Sep. 23, 2008

(51) Int. Cl.
*H01R 13/648* (2006.01)

(52) U.S. Cl. ..... 439/607.36; 439/78; 439/108; 439/629

(58) Field of Classification Search ..... 439/78, 439/92, 95, 101, 108, 607.31, 607.32, 607.35, 439/607.36, 607.37, 607.54, 607.56, 629, 439/630, 947
See application file for complete search history.

(56) References Cited

U.S. PATENT DOCUMENTS 5,066,236 A * 11/1991 Broeksteeg ..... 439/79
6,099,327 A * 8/2000 Chen ..... 439/95
6,241,555 B1 * 6/2001 Okuyama et al. ..... 439/607.01
6,267,624 B1 * 7/2001 Wu et al. ..... 439/607.35
6,478,623 B1 * 11/2002 Wu ..... 439/607.35
6,767,225 B1 * 7/2004 Hwang ..... 439/79
7,229,298 B2 * 6/2007 Shen et al. ..... 439/95
7,300,312 B1 * 11/2007 Chen et al. ..... 439/607.31
2006/0121782 A1 * 6/2006 Shen et al. ..... 439/607
2006/0292930 A1 * 12/2006 Shimoyama ..... 439/607
2007/0197093 A1 * 8/2007 Chen et al. ..... 439/607

* cited by examiner

*Primary Examiner*—James Harvey
(74) *Attorney, Agent, or Firm*—Rosenberg, Klein & Lee

(57) ABSTRACT

An electrical connector adapted for being electrically connected with a PCB stably, includes an insulating housing defining a plurality of terminal passageways for receiving terminals and at least one through-hole located at one side of the terminal passageways. The insulating housing has two opposite holding blocks which defines two guiding recesses facing each other for locating the PCB. A shell encircles the insulating housing and defines at least one pressing slice passing through the through-hole and pressing against one surface of the PCB. Each of the terminals has a soldering portion exposed out of the terminal passageway and pressing against the other surface of the PCB.

6 Claims, 3 Drawing Sheets

ELECTRICAL CONNECTOR

BACKGROUND OF THE INVENTION

1. Field of the Invention

The present invention relates to an electrical connector, and more particularly to an electrical connector capable of stably being connected with a printed circuit board.

2. The Related Art

In general, a conventional electrical connector adapted for being connected with a printed circuit board (PCB) includes an insulating housing, a plurality of terminals received in the insulating housing and a shell enclosing the insulating housing. Each of the terminals has a welded tail portion projecting out of the insulating housing and pressing against one surface of the PCB for being soldered thereto.

The above-mentioned electrical connector is mounted to the PCB with the welded tail portions of the terminals soldered to one side of the PCB. However, the soldering area between the welded tail portion of each terminal and the PCB is small, which makes the weld therebetween unsteady and easily causes unreliable connection between the PCB the electrical connector.

SUMMARY OF THE INVENTION

It is an object of the present invention to provide an electrical connector capable of stably being connected with a printed circuit board (PCB). The electrical connector includes an insulating housing having a basic body which has two opposite holding blocks extending from two opposite ends of the basic body and a mating portion extending from one side of the basic body opposite to the holding blocks. The basic body defines at least one through-hole which penetrates through the basic body. The mating portion defines a plurality of terminal passageways rowed transversely which penetrate through the basic body and the mating portion and are located adjacent to one side of the through-hole. The two holding blocks define two guiding recesses facing each other for locating the PCB. A plurality of terminals is received in the corresponding terminal passageways. Each of the terminals has a soldering portion extending outside of the terminal passageways for being soldered to one surface of the PCB. A shell encircles the mating portion of the insulating housing and has at least one pressing slice passing through the through-hole of the basic body for pressing against and electrically contacting a grounding point defined on the other surface of the PCB.

As described above, two opposite sides of the PCB are located in the guiding recesses of the insulating housing, the pressing slice of the shell and the soldering portions of the terminals respectively press against two contrary surfaces of the PCB, so that the PCB is connected with the electrical connector firmly.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
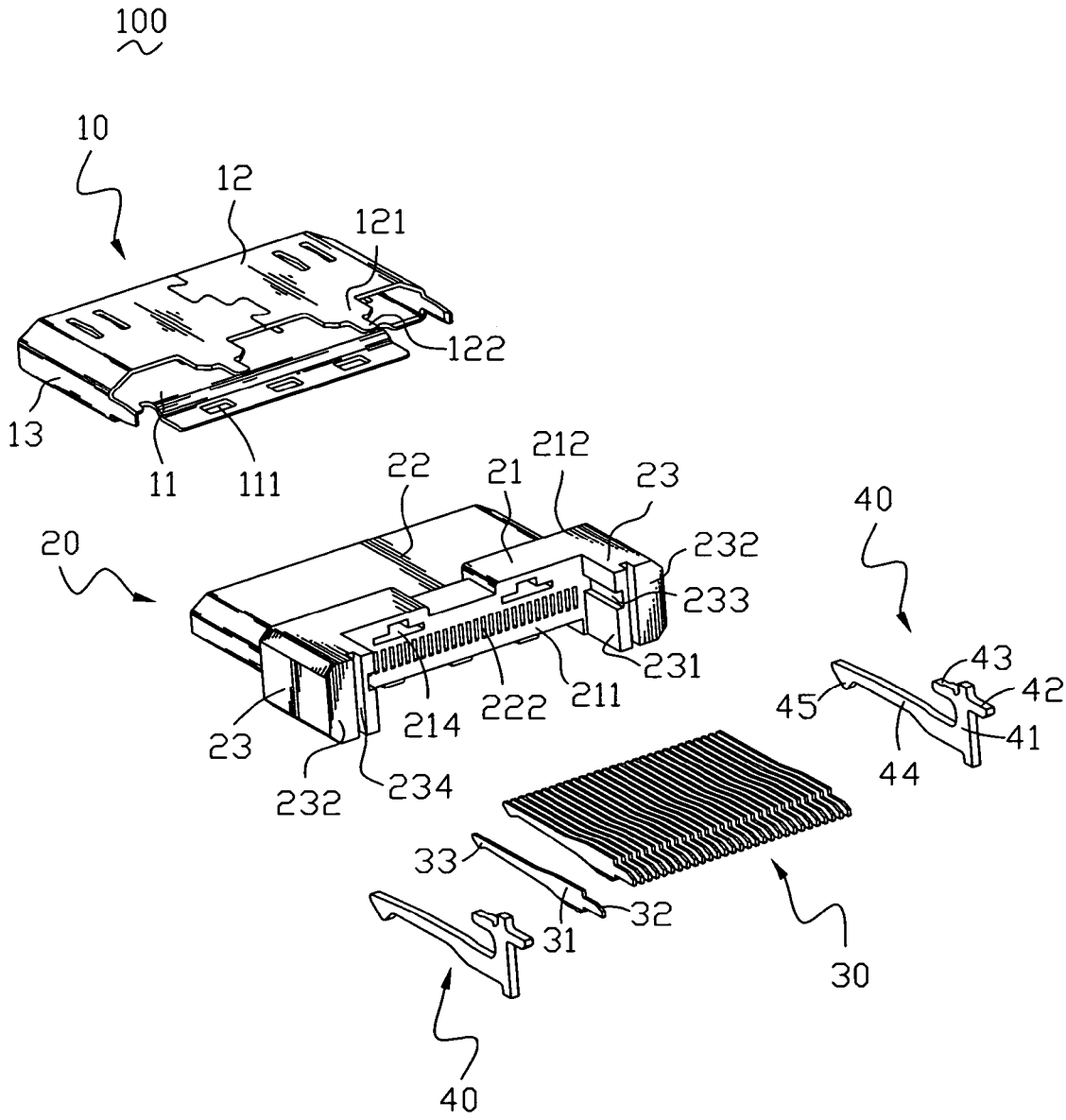
FIG. 1 is an exploded view of an electrical connector in accordance with the present invention.

With reference to FIG. 1, an electrical connector 100 according to the invention includes a shell 10, an insulating housing 20, a plurality of terminals 30, and a pair of fixing elements 40.

Figure 2:
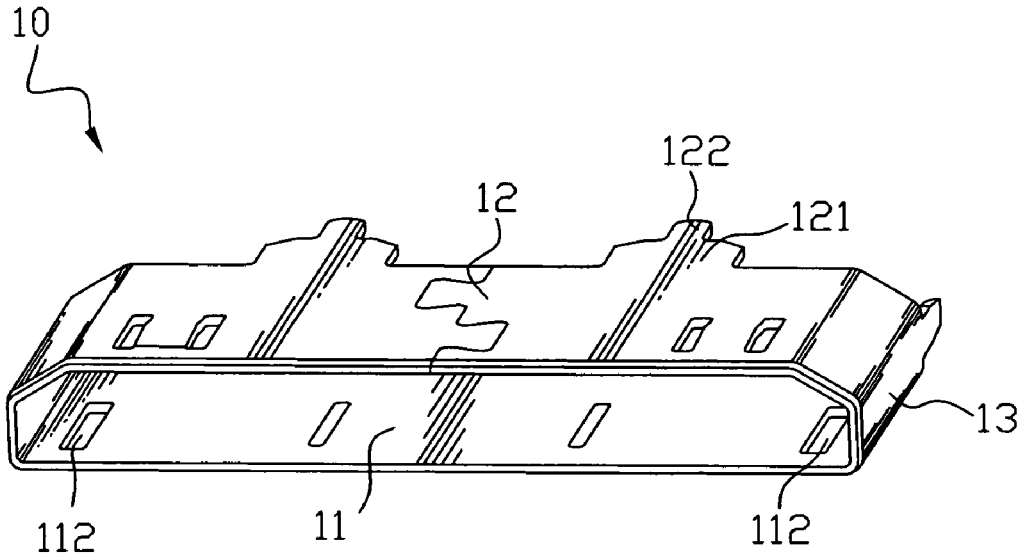
FIG. 2 is a perspective view showing a shell of the electrical connector.

The shell 10 has a bottom wall 11, a top wall 12 oppositely parallel to the bottom wall 11 and two opposing sidewalls 13 connected with the bottom wall 11 and the top wall 12, all of which collectively define a receiving room for receiving the insulating housing 20 therein. The bottom wall 11 has plural location holes 111 aligned at a front portion thereof and two receiving slots 112 (as shown in FIG. 2) respectively adjacent to the sidewalls 13 at a rear portion thereof. The top wall 12 defines two extending slices 121 abreast extending forward from a front side thereof. Each of the extending slices 121 has a narrow pressing slice 122 continuously extending forward from a middle portion of a front end thereof.

Figure 3:
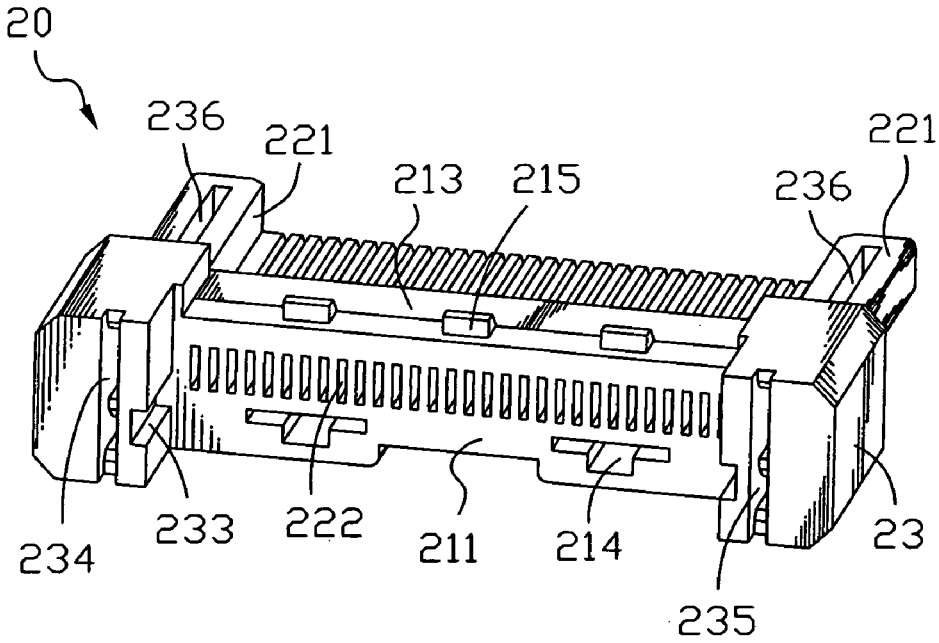
FIG. 3 is a perspective view showing an insulating housing of the electrical connector.

Please refer to FIG. 1 and FIG. 3 together, the insulating housing 20 has a substantially rectangular basic body 21 which defines a front surface 211, a rear surface 212 and a bottom surface 213. A substantially flat mating portion 22 extends rearward from a middle portion of the rear surface 212 of the basic body 21. The basic body 21 defines two through-holes 214 apart from each other at an upper portion thereof, while the through-holes 214 are in the same plane with a top surface of the mating portion 22. The bottom surface 213 of the basic body 21 defines plural substantially wedge-shaped lumps 215 abreast projecting therefrom. The mating portion 22 defines two butting portions 221 respectively protruding downward from two opposite ends of a bottom side thereof and a plurality of terminal passageways 222 positioned between the two butting portions 221. The terminal passageways 222 further penetrate through the front surface 211 of the basic body 21.

Two opposite sides of the front surface 211 of the basic body 21 have a holding block 23 projecting therefrom respectively. Each holding block 23 has an inner side 231 perpendicular to the front surface 211 and a front side 232 perpendicularly connected to the inner side 231 and parallel to the front surface 211. The inner side 231 of the holding block 23 defines a guiding recess 233 extending from the front side 232 and terminating to the front surface 211 of the basic body 21. The front side 232 of the holding block 23 defines a receiving recess 234 longitudinally extending. A bottom of the receiving recess 234 defines a receiving cavity 235 and a containing groove 236 separately extending towards the inner of the basic body 21. The containing groove 236 further penetrates through the basic body 21 and extends into the butting portions 221 of the mating portion 22.

Refer to FIG. 1 again, each of the terminals 30 has a base portion 31, a soldering portion 32 extending forward from a front end of the base portion 31 and an elongated contacting portion 33 extending rearward from a rear end of the base portion 31.

Each fixing element 40 has a main portion 41 disposed vertically. An upper portion of the main portion 41 has an extending portion 42 and a fixing portion 43 extending in opposite directions. A lower portion of the main portion 41 has a slender elastic portion 44 extending towards the same direction as the fixing portion 43. The elastic portion 44 has a projection 45 protruding downward from a free end thereof.

Figure 4:
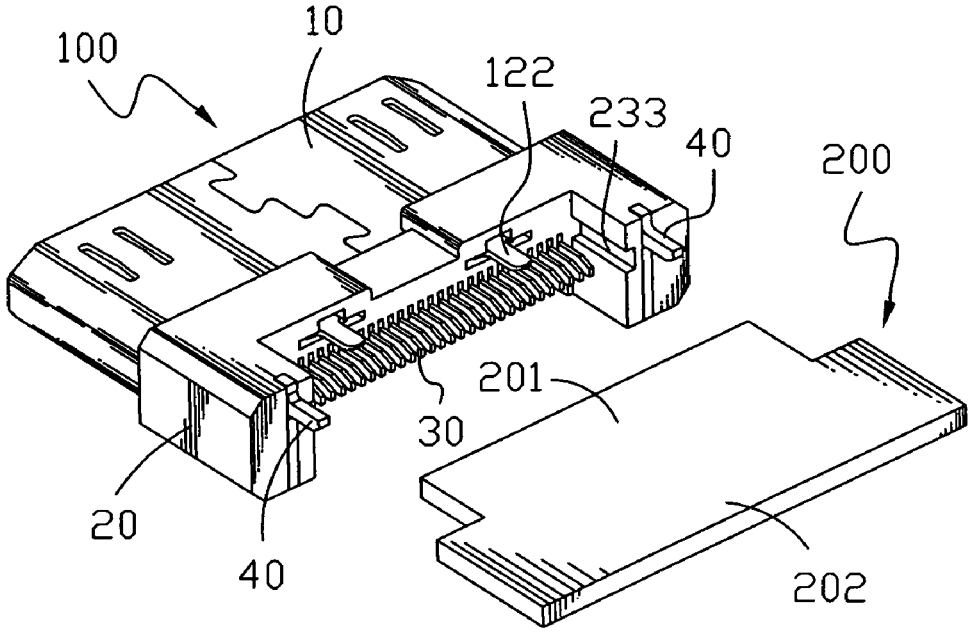
FIG. 4 is a perspective view of the electrical connector shown in FIG. 1 and a printed circuit board, showing in a state before the electrical connector is mounted to the printed circuit board.

In assembly, the plurality of terminals 30 are received in the corresponding terminal passageways 222 of the insulating housing 20 and the soldering portions 32 are kept out of the terminal passageways 222 for being soldered to a printed circuit board (PCB) 200 (see FIG. 4). Then, the fixing elements 40 are assembled to the insulating housing 20. In this case, the main portions 41 are received in the receiving recesses 234, the extending portions 42 are exposed out of the receiving recesses 234, the fixing portions 43 are inserted into the receiving cavities 235, the elastic portions 44 are contained in the containing grooves 236 and the projections 45 project out of the containing grooves 236. Next, the shell 10 encircles the housing 20 with the mating portion 22 received in the shell 10. The extending slices 121 are received in the through-holes 214 while the pressing slices 122 pass through and extend out of the through-holes 214. The wedge-shaped lumps 215 are engaged with the corresponding location holes 111. And that the projections 45 of the fixing elements 40 project out of the receiving slots 112 of the shell 10 for cooperating with a complementary connector (not shown).

Figure 5:
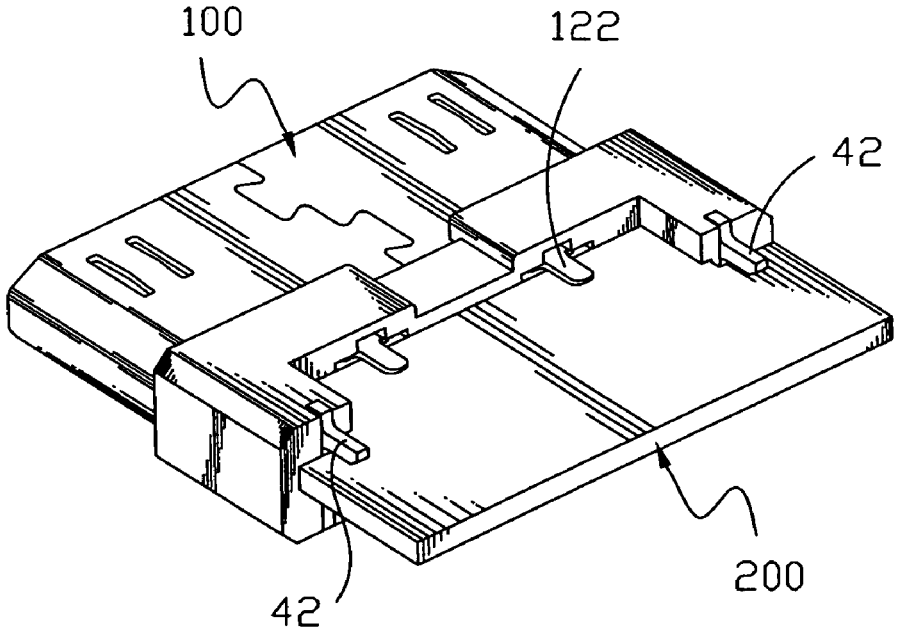
FIG. 5 is an assembly view of the electrical connector and the printed circuit board shown in FIG. 4.

Refer to FIGS. 4 and 5, the electrical connector 100 is capable of being mounted to the PCB 200 which defines a first segment 201 and a second segment 202 wider than and connected together with the first segment 201. Both of the first segment 201 and the second segment 202 have grounding points (not shown) on top surfaces thereof.

The electrical connector 100 is assembled with the PCB 200 in such a manner that two opposite sides of the first segment 201 slide along the guiding recesses 233 until the second segment 202 is stopped by the holding blocks 23. In this case, the two opposite sides of the first segment 201 are located in the guiding recesses 233, the pressing slices 122 of the shell 10 and the soldering portions 32 of the terminals 30 respectively press against two contrary surfaces of the first segment 201, and, the extending portions 42 of the fixing elements 40 are also against the second segment 202. Thus, the PCB 200 is stably electrically connected with the electrical connector 100. Furthermore, both of the pressing slices 122 and the extending portions 42 electrically contact the corresponding grounding points of the PCB 200, which shields an Electro Magnetic Interference (EMI) between the electrical connector 100 and the PCB 200.

As the above description, the two opposite sides of the first segment 201 of the PCB 200 are located in the guiding recesses 233 of the housing 20, the pressing slices 122 of the shell 10 and the soldering portions 32 of the terminals 30 respectively press against two contrary surfaces of the first segment 201, so that the PCB 200 is connected with the electrical connector 100 firmly. Besides, the extending portions 42 of the fixing elements 40 press against the second segment 202 of the PCB 200 and electrically contact the corresponding grounding points of the second segment 202, which not only stabilizes the PCB 200 to the electrical connector 100, but also strengthens grounding effects between the electrical connector 100 and the PCB 200, then further ensures the assembly thereof against an EMI.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector adapted for being electrically connected with a printed circuit board, comprising:

an insulating housing having a basic body which has two opposite holding blocks extending from two opposite ends of the basic body and a mating portion extending from one side of the basic body opposite to the holding blocks, the basic body defining at least one through-hole which penetrates through the basic body, the mating portion defining a plurality of terminal passageways rowed transversely with respect to a mating direction of the connector, the terminal passageways which penetrate through the basic body and the mating portion are located adjacent to one side of the through-hole, the two holding blocks defining two guiding recesses facing each other for locating the printed circuit board;

a plurality of terminals received in the corresponding terminal passageways, each of the terminals having a soldering portion extending outside of the terminal passageway for being soldered to one surface of the printed circuit board; and a shell encircling the mating portion of the insulating housing, the shell having at least one pressing slice passing through the through-hole of the basic body for pressing against and electrically contacting a grounding point defined on the other surface of the printed circuit board.

2. The electrical connector as claimed in claim 1, further comprising a pair of fixing elements respectively fixed into the two holding blocks, each of the fixing elements has an extending portion exposed out of the holding block for pressing against and electrically contacting another grounding point defined on the PCB.

3. The electrical connector as claimed in claim 2, wherein the fixing element has a main portion received in a receiving recess defined in the holding block, the extending portion extends from the main portion.

4. The electrical connector as claimed in claim 3, wherein a bottom of the receiving recess defines a receiving cavity extending towards an interior of the holding block, the main portion of the fixing element has a fixing portion which extends in an opposing direction with the extending portion and is inserted into the receiving cavity for fixing the fixing element to the insulating housing.

5. The electrical connector as claimed in claim 3, wherein the main portion of the fixing element defines a slender elastic portion extending in a direction opposite to the extending portion, the holding block defines a containing groove extending from a bottom of the receiving recess and penetrating through the basic body and extending into the mating portion for receiving the elastic portion.

6. The electrical connector as claimed in claim 5, wherein the elastic portion of the fixing element has a projection projecting out of the containing groove and a receiving slot formed in the shell.

* * * * *